United States Patent [19]

Branca et al.

[11] Patent Number: 4,781,038

[45] Date of Patent: Nov. 1, 1988

[54] LINKABLE GEM SETTING

[75] Inventors: Robert G. Branca, No. Providence, R.I.; Robert H. Goretti, Attleboro, Mass.; Nicholas A. Cambio, Johnston, R.I.

[73] Assignee: Hab Tool, Inc., Johnston, R.I.

[21] Appl. No.: 54,878

[22] Filed: May 26, 1987

[51] Int. Cl.[4] ..... A44C 5/10; A44C 17/02; A44C 27/00

[52] U.S. Cl. ..... 63/26; 63/4; 63/28; 59/80

[58] Field of Search ..... 63/5 R, 11, 4, 3, 26, 63/27, 28, 29.1; 59/80, 90, 79.1, 82

[56] References Cited

U.S. PATENT DOCUMENTS

| | | | |
|---|---|---|---|
| 761,867 | 6/1904 | Artopoens | 63/26 |
| 1,476,462 | 12/1923 | Pejchar | 59/80 |
| 1,573,927 | 2/1926 | Fulford | 59/80 |
| 2,003,950 | 6/1935 | Pejchar | 63/26 X |
| 2,136,818 | 11/1938 | Kestenman | 59/80 |
| 2,584,207 | 2/1952 | Holl | 63/27 |
| 2,902,821 | 9/1959 | Kelly | 59/80 |

FOREIGN PATENT DOCUMENTS

| | | | |
|---|---|---|---|
| 191165 | 12/1907 | France | 59/80 |
| 473655 | 10/1914 | France | 59/80 |

*Primary Examiner*—Richard J. Johnson
*Attorney, Agent, or Firm*—Salter & Michaelson

[57] ABSTRACT

A linkable gem setting includes a base element, a plurality of upstanding fingers on the base element, and an apertured tab which extends outwardly from the base element for interlinking the setting with another setting of the similar configuration. In one embodiment of the gem setting, the apertured tab of a first setting is receivable on one of the fingers of a second setting of similar configuration for linking the two settings together so that when a gem is assembled in the fingers of the second setting, the gem retains the two settings in linked relation. In another embodiment of the setting, a connector arm is provided on the base element so that the apertured tab of a first setting is receivable in interlinked engagement with the connector arm of a second setting to secure the two settings together.

6 Claims, 1 Drawing Sheet

LINKABLE GEM SETTING

BACKGROUND AND SUMMARY OF THE INVENTION

The instant invention relates to ornamental jewelry and more particularly to a gem setting which is adapted to be linked together with other similar gem settings to form chains and other jewelry items comprising connected gem setting assemblies.

The concept of providing a jewelry item comprising a chain or string of linked or otherwise connected gem setting assemblies, each of which comprises a setting having a gem mounted therein, has been generally known in the jewelry art for many years. In this regard, chains and the like of the type comprising a plurality of connected gem setting assemblies have been embodied in various earrings, necklaces, bracelets and pendants, and they have generally been found to have significant degrees of appeal. However, the heretofore available chains and other items of this type have generally been relatively expensive since they have generally included relatively complicated gem setting structures in order to enable the individual settings thereof to be linked or connected together. Accordingly, the heretofore available chains and other items of this type have generally not been readily adapted to be embodied in relatively inexpensive costume jewelry.

The instant invention provides an effective gem setting which has a relatively simple construction and which is adapted to be embodied in a variety of different jewelry items, such as pendants, necklaces, bracelets and earrings. Further, the gem setting of the subject invention is adapted to be made in a variety of relatively inexpensive constructions so that it can be effectively embodied in various costume jewelry items. Specifically, the gem setting of the instant invention comprises a base element, at least three upstanding fingers on the base element which are adapted for receiving and securing a gem therein, and an apertured tab which is receivable in engagement with a second gem setting of similar configuration for linking the two gem settings together. In a first embodiment of the gem setting, the apertured tab is receivable on one of the fingers of a second gem setting of similar configuration for securing the two gem settings together. When the first embodiment of the gem setting is assembled in combination with a second gem setting in this manner, a gem can be assembled in the second gem setting so that the gem prevents the tab of the first gem setting from being disassembled therefrom. The first embodiment of the gem setting is preferably further constructed so that the base thereof is substantially flat and so that the apertured tab thereof is receivable on one of the fingers of a second setting so that it is positioned adjacent the base of the second setting. Further, the gem setting is preferably die struck in a stamping process so that the upstanding fingers have a sufficient degree of resilience to enable a gem to be snap received therein and held under tension without requiring peening or soldering. A second embodiment of the gem setting of the subject invention further comprises a second apertured tab on the base element thereof for linking the gem setting to two gem settings of similar configuration in nonaligned relation to form various ornamental jewelry structures. A third embodiment of the gem setting of the subject invention comprises a base element, at least three upstanding fingers on the base element, an apertured tab on the base element and a connector arm on the base element which is receivable in interlinked engagement in an apertured tab of a second gem setting of similar configuration to link the two gem settings together.

It has been found that the gem setting of the instant invention is highly practical and adapted to be embodied in a variety of different ornamental jewelry items. In this regard, the gem setting of the subject invention is preferably die struck so that it can be made in relatively inexpensive constructions and so that various gems can be assembled therein without requiring peening or soldering operations. The various embodiments of the gem setting are simple and adapted to be easily interlinked with other similar settings to form chains and other structures of linked gem setting assemblies. Further, when two of the gem settings of the subject invention are linked together, the basic structure of the settings causes the connecting structure therebetween to be positioned either even with or above the rear surfaces of the base elements of the settings. As a result, when a chain or the like comprising a plurality of the settings of the subject invention is worn around the wrist or neck, the connecting structure thereof does not irritate the wearer.

Accordingly, it is a primary object of the instant invention to provide an effective and economical linkable gem setting.

Another object of the instant invention is to provide an effective linkable gem setting wherein an apertured tab on a first gem setting is receivable on an upstanding finger of a second gem setting of similar configuration and retained on the finger when a gem is assembled in the second setting.

An even further object of the instant invention is to provide a linkable gem setting which can be embodied in a variety of relatively inexpensive constructions.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
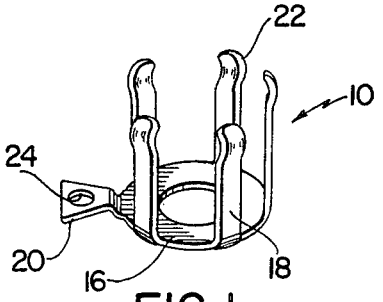
FIG. 1 is a perspective view of a first embodiment of the gem setting of the subject invention.
Figure 2:
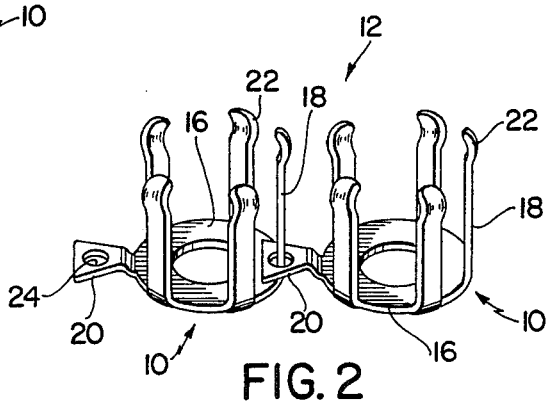
FIG. 2 is a perspective view of a pair of the gem settings in interlinked relation.
Figure 3:
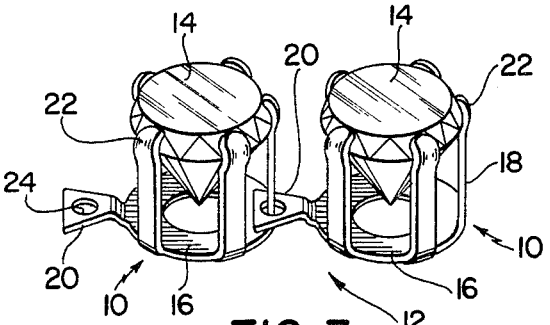
FIG. 3 is a similar view with gems received in the gem settings.

Referring now to the drawing, a first embodiment of the gem setting of the subject invention is illustrated and generally indicated at 10 in FIGS. 1–3. The gem setting 10 is adapted to be assembled with other gem settings 10 in the manner illustrated in FIGS. 1–3 to form the gem setting combination generally indicated at 12 in FIGS. 2 and 3, and it is adapted for receiving and securing a gem 14 therein in the manner illustrated in FIG. 3.

The gem setting 10 is preferably integrally die struck from a suitable malleable metal, such as brass, gold, silver, etc.; and it comprises a substantially flat, circular base element 16, at least three fingers 18 which extend upwardly from the base element 16, and an apertured tab 20 which extends outwardly from the base element 16. The fingers 18 include inwardly cupped or recessed terminal mounting portions 22 which are adapted for receiving and engaging the peripheral rim portions of a gem 14 to retain and mount the gem 14 therein. The apertured tab 20 of the gem setting 10 is preferably integrally struck with the base element 16 thereof and formed so that it extends slightly upwardly and then outwardly from the base element 16. Further, it will be understood that settings having base elements of other configurations such as oval or marquis are contemplated.

The gem setting 10 is adapted to be assembled in linked relation with a second gem setting 10 to provide the combination 12 illustrated in FIGS. 2 and 3. Specifically, the setting 10 is constructed so that the apertured tab 20 thereof is receivable on one of the fingers 18 of a second gem setting 10 with the apertured tab 20 of the first setting 10 positioned adjacent the base element 16 of the second gem setting 10. A gem 14 can then be assembled in the upstanding fingers 18 of the second gem setting 10 to form a gem setting assembly. In this regard, once the gem 14 has been assembled in the second gem setting 10 in this manner, it inherently prevents the tab 20 of the first gem setting 10 from being removed from the second gem setting 10 to retain the two gem settings in assembled relation. Further, when the gem settings 10 are formed as die struck pieces, the fingers 18 of the second gem setting 10 resiliently embrace the gem 14 received therein so that the gem 14 is effectively retained without expensive soldering or peening operations.

Figure 4:
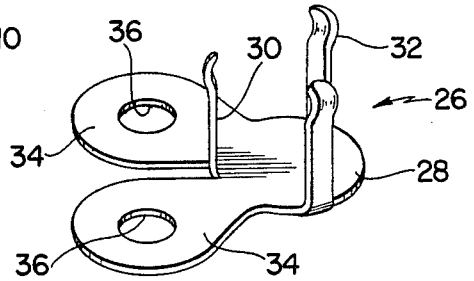
FIG. 4 is a perspective view of a second embodiment of a gem setting of the subject invention.

A second embodiment of the gem setting of the instant invention is illustrated in FIG. 4 and generally indicated at 26. The gem setting 26 is also preferably integrally die struck from a suitable malleable metal, and it comprises a base element 28, at least three upstanding fingers 30 having terminal mounting portions 32 thereon, and a pair of tabs 34 having apertures 36 therein which extend outwardly from the base element 28. The gem setting 26 is adapted to be assembled in combination with at least two other gem settings 26 or with other gem settings of a similar type, such as a gem setting 10. In this regard, since the gem setting 26 includes a pair of nonaligned apertured tabs 34, each of the tabs 34 can be assembled on a finger 30 of another gem setting 26; and, as a result, the gem setting 26 can be assembled with a plurality of gem settings which are positioned in nonaligned relation to form various types of ornamental jewelry pieces. The terminal portions 32 of the fingers 30 are adapted to receive a gem 14 therein in a manner similar to that illustrated in FIG. 3 with respect to the gem setting 10 so that when the apertured tabs of one or more gem settings have been previously assembled with the gem setting 26, the gem 14 is operative for retaining the tabs on the setting 26.

Figure 5:
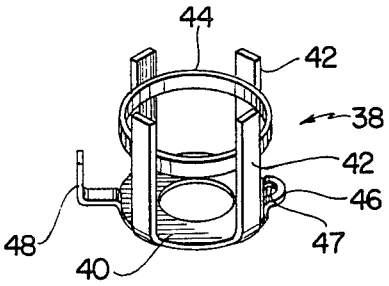
FIG. 5 is a perspective view of a third embodiment of the gem setting of the subject invention.
Figure 6:
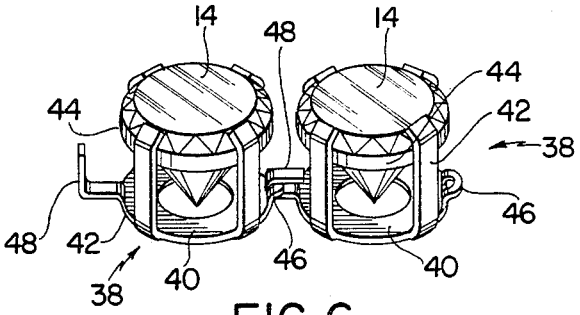
FIG. 6 is a perspective view of a pair of the gem settings illustrated in FIG. 5 linked together and with gems received therein.

A third embodiment of the gem setting of the instant invention is illustrated in FIGS. 5 and 6 and generally indicated at 38. The gem setting 38 is preferably also made from a suitable ductile metal, such as brass; although, as herein embodied, it is made from two separate die struck pieces which are connected by soldering. The gem setting 38 comprises a base element 40, and at least three fingers 42 which extend integrally upwardly from the base element 40. An upper ring 44 is soldered to the inner sides of the fingers 42, and a tab 46 having an aperture 47 therein and a connector arm 48 are integrally formed with the base element 40 so that they extend outwardly from substantially opposite sides thereof. The base element 40 and the upper ring 44 as hereinafter embodied are of substantially circular configuration, although it will be understood that gem settings having base elements and upper rings of other configurations such as oval or marquis are contemplated. The gem setting 38 is adapted to be assembled in combination with a second gem setting 38 in the manner illustrated in FIG. 6 so that the connector arm 48 of the second gem setting 38 extends through the apertured tab 46 of the first setting 38 and is then bent over to secure the arm 48 in interlinked engagement with the second setting 38. The gem setting 38 is further adapted for receiving a gem 14 therein so that the peripheral portions of the gem 14 rest on the ring 44 with the upper extremities of the fingers 42 peened over to capture the gem 14 in the setting 38 as ilustrated in FIG. 6.

It is seen, therefore, that the instant invention provides an effective linkable gem setting. Specifically, the gem setting 10 is adapted to be effectively and easily linked with a second gem setting of similar configuration simply by assembling the apertured tab 20 of the first gem setting 10 on one of the fingers 18 of the second gem setting 10 and then assembling a gem 14 in the fingers 18 of the second setting 10. The gem setting 26 is adapted to be assembled with several additional gem settings of identical or similar configurations in a manner similar to the gem setting 10, and the gem setting 38 is adapted to be interlinked with a second gem setting 38 with the aperture tab 46 of the first setting 38 received in interlinked engagement with the connector arm 48 of the second setting 38. The gem settings 10, 26 and 38 are relatively simple and adapted to be embodied in relatively inexpensive constructions. Further, when the gem settings 10, 26 and 38 are assembled with other similar gem settings, the linking structures of the settings are generally positioned above the back surfaces of the respective base elements thereof so that jewelry items embodying the gem settings 10, 26 or 38 do not normally irritate the skin of wearers thereof, Accordingly, it is seen that the instant invention represents a significant adavancement in the jewerly art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. In combination, a first gem setting comprising a first base element, at least three resilient upstanding first fingers on said first base element, said first fingers including inwardly facing recessed terminal mounting portions adjacent the terminal ends thereof and being adapted to be resiliently flexed to enable a gem to be snap received and retained in engagement in the mounting portions thereof without thereafter deforming the first fingers, and first engagement means extending outwardly from said first base element for engaging at least one finger of another gem setting of similar configuration in order to link said first gem setting thereto, a first gem snap received in engagement in the mounting portions of said first fingers so that it is supported in upwardly spaced relation to said first base portion, a second gem setting comprising a second base element, at least three resilient upstanding second fingers on said second base element, said second fingers including inwardly facing recessed terminal mounting portions adjacent the terminal ends thereof and being adapted to be resiliently flexed to enable a gem to be snap received and retained in engagement in the mounting portions thereof without thereafter deforming the second fingers, said first engagement means engaging at least one of said second fingers in order to link said first and second gem settings together, and a second gem snap received in engagement in the mounting portions of said second fingers to that it is supported in upwardly spaced relation to said second base portion, said first engagement means being engageable with said second gem and being thereby retained in engagement with said second fingers by said second gem.

2. In the gem setting of claim 1, said first engagement means comprising an apertured tab extending outwardly from said first base portion and received on one of said second fingers.

3. In the combination of claim 1, said first and second gem settings further characterized as being die struck.

4. In combination, a unitary first gem setting comprising a first base element, at least three resilient upstanding first fingers on said first base element, said first fingers including inwardly facing recessed terminal mounting portions adjacent the terminal ends thereof and being adapted to be resiliently flexed to enable a gem to be snap received and retained in engagement in the mounting portions thereof without thereafter deforming the first fingers, and first engagement means extending outwardly from said first base element for engaging at least one finger of another gem setting of similar configuration in order to link said first gem setting thereto, a first gem snap received in engagement in the mounting portions of said first fingers to that it is supported in upwardly spaced relation to said first base portion, a unitary second gem setting comprising a second base element, at least three resilient upstanding second fingers on said second base element, said second fingers including inwardly facing recessed terminal mounting portions adjacent the terminal ends thereof and being adapted to be resiliently flexed to enable a gem to be snap received and retained in engagement in the mounting portions thereof without thereafter deforming the second fingers, said first engagement means engaging at least one of said second fingers in order to link said first and second gem settings together, and a second gem snap received in engagement in the mounting portions of said second fingers so that it is supported in upwardly spaced relation to said second base portion, said first engagement means being retained in engagement with said second fingers by said second gem.

5. In the gem setting of claim 4, said first engagement means comprising an apertured tab extending outwardly from said first base portion and received on one of said second fingers.

6. In the combination of claim 4, said first and second gem settings further characterized as being die struck.

* * * * *